US005741596A

United States Patent [19]

Skowronski et al.

[11] Patent Number: 5,741,596

[45] Date of Patent: Apr. 21, 1998

[54] COATING FOR OXIDATION PROTECTION OF METAL SURFACES

[75] Inventors: Raymund P. Skowronski, Woodland Hills; David Kramer, Port Hueneme, both of Calif.

[73] Assignee: Boeing North American, Inc., Seal Beach, Calif.

[21] Appl. No.: 313,002

[22] Filed: Feb. 21, 1989

[51] Int. Cl.[6] ..... B32B 15/04; B22F 3/00; B05D 5/12

[52] U.S. Cl. ..... 428/457; 428/552; 427/103; 427/126.2; 419/12; 419/13

[58] Field of Search ..... 428/457, 552; 427/103, 126.2; 419/12, 13

[56] References Cited

U.S. PATENT DOCUMENTS 3,966,790 6/1976 Hindin et al. ..... 502/242
4,290,847 9/1981 Johnson et al. ..... 428/402.2 X
4,585,752 4/1986 Ernest ..... 502/304
4,879,165 11/1989 Smith ..... 428/113 X

*Primary Examiner*—Peter A. Nelson
*Attorney, Agent, or Firm*—Harry B. Field

[57] ABSTRACT

An oxidation protection coating for metal substrate surfaces. The coating, according to a preferred embodiment, comprises an initial or first layer of a glass-ceramic, such as a barium aluminosilicate composed chiefly of baria, silica and alumina; or mullite, composed of silica-alumina or, alternatively, baria-silica. Titanium dioxide, nickel oxide or $SnO_2$ can be added. The next layer of the coating is comprised of alumina or silicon carbide. The third or final layer is comprised of a thin layer of silica or a high-silica material, e.g., a silica containing 4% $B_2O_3$. For a thicker third layer, particles of a dark solid, such as boron silicide, ferrous oxide, ferric oxide, nickel oxide, manganese dioxide, carbon or silicon carbide, can be incorporated. The three-layer coating provides high emittance and low catalytic activity for the recombination of oxygen and nitrogen, as well as being a hydrogen diffusion barrier.

30 Claims, No Drawings

COATING FOR OXIDATION PROTECTION OF METAL SURFACES

STATEMENT OF GOVERNMENT INTEREST

The Government has rights in this invention pursuant to Contract F33657-87-C-2214 awarded by the U.S. Department of Air Force.

BACKGROUND OF THE INVENTION

1. Field of the Invention

This invention relates to the field of coatings, and particularly to coatings for the protection of metal surfaces from oxidation.

2. Description of the Prior Art

The prior art relating to coatings for oxidation protection of metal surfaces is well developed. However, effective coatings for metals and metal alloys, such as aluminum and titanium aluminide, which provide oxidation protection, high emittance, low catalytic activity for the recombination of atomic oxygen and nitrogen, as well as a barrier to hydrogen diffusion, are especially important for application to aircraft and aerospace structures.

SUMMARY OF THE INVENTION

According to the invention, a three-layer coating is provided on a metal surface. The initial layer on the substrate, e.g., titanium aluminide, is a substance termed a glass-ceramic, which can be (a) a barium aluminosilicate composed chiefly of baria, silica and alumina, or (b) mullite, which is silica-alumina, or (c) baria-silica, e.g., in the form of barium silicate. This layer functions as a bonding layer and is selected to match the coefficient of thermal expansion of the metal substrate. The thickness of this layer can range from about 1 to about 50 μm.

The next layer of the coating can be composed of alumina ($Al_2O_3$) or silicon carbide (SiC) and can have a thickness ranging from about 1 to about 50 μm. This layer functions to provide an improved hydrogen diffusion barrier.

The final layer is composed of silica or a high silica material, such as $SiO_2$ containing 4% $B_2O_3$. This layer provides a low-catalycity surface. If a thin layer, i.e., 1 to 5 μm, is used, the emittance will be significantly increased by the presence of the $Al_2O_3$ or SiC when used in the second layer. If a thicker layer is used, particles or whiskers of a black solid, such as ferric oxide or boron silicide, can be incorporated in the layer.

Under certain conditions, as noted below, the second layer can be deleted and the third layer applied over the first layer, and in some instances, the initial or first layer may be sufficient alone, without the other two layers.

OBJECTS OF THE INVENTION

It is accordingly an object of the invention to provide a coating for oxidation protection of metals.

Another object of the invention is the provision of a coating for metals, such coating having high emittance and low catalytic activity for the recombination of atomic oxygen and nitrogen.

A further object is the provision of a coating for metals which functions as a barrier to hydrogen diffusion.

Yet another object is the provision of an inorganic refractory coating for metals having the above characteristics, using a hydrogen diffusion barrier layer and a glass-ceramic.

Another object is to provide a coating with good adhesion during thermal cycling to 1000° C.

An additional object is to provide procedure for applying the above coating to a metal substrate.

DETAILED DESCRIPTION OF THE INVENTION AND THE PREFERRED EMBODIMENTS

The coating of the present invention provides oxidation protection of metal surfaces, high emittance (>0.8) at 1000° C., low catalytic activity for the recombination of atomic oxygen and nitrogen, as well as being a barrier to hydrogen diffusion and also oxygen diffusion.

The substrates which can be coated and protected according to the invention include various metals. Representative of metals which can be protected according to the invention are aluminum, aluminum alloys, titanium and its alloys, e.g., titanium aluminide, beryllium, and the refractory metals, and alloys thereof. The term "metals" as employed herein is accordingly intended to include both metals and metal alloys.

The initial layer applied to the substrate, e.g., titanium aluminide, is a glass-ceramic which is selected to match closely the coefficient of thermal expansion of the substrate. For this purpose, the initial layer generally has a high coefficient of thermal expansion, which is particularly effective for bonding the initial layer to metals and maintaining adherence of the coating to the substrate under varying temperature conditions.

The glass-ceramic of the first or initial layer, especially adapted for high temperature applications, can be composed of (1) baria, silica and alumina (for example, as present in barium aluminosilicate), or (2) silica-alumina, or (3) baria-silica, as in barium silicate. The preferred composition of the glass-ceramic employed as the initial layer depends on the metal substrate to which it is applied. The range of proportions of the components of the first composition noted above is 30–60% silica, 20–55% baria, and 7–25% alumina, by weight. The range of proportions for the second composition is 97–30% silica and 3–70% alumina, by weight, and the range of proportions for the third composition is 18–54% silica and 46–82% baria, by weight. The term "glass-ceramic" as employed herein is intended to denote a polycrystalline solid derived from the controlled crystallization of a glass.

Preferably, a minor amount of nickel oxide (NiO), titanium dioxide ($TiO_2$) or stannic oxide ($SnO_2$), in a proportion of about 0.1 to about 18%, e.g., 7%, by weight, is incorporated in the glass-ceramic of the initial layer, as the nucleation catalyst.

The above coating compositions forming the initial layer can be prepared by sol-gel, electrospraying/sintering, electrophoresis or thermophoresis procedures. In the sol-gel procedure, the appropriate precursors are dissolved in a solvent, e.g., an alcohol. Thus, for the three-component glass-ceramic composition noted above, an appropriate precursor for the silica is tetraethyl orthosilicate (TEOS); for baria, barium butoxide; and for alumina, aluminum isopropoxide or aluminum secondary butoxide. The solution is refluxed and stirred under isothermal conditions at 60° C. Temperatures from 20°–100° C. can be used in this step. The solution is then hydrolyzed by adding water and allowed to polymerize into a gel. It is then sintered into a glass in the temperature range of 800°–1000° C. Heat treatments up to about 1100° C. can be used to form the glass-ceramic depending on the composition. Preparation of a silica-alumina or a baria-silica layer follows substantially the same procedure.

In practice, the sol is placed or applied directly on the metal substrate and is then heated to drive off the solvent, followed by hydrolysis for converting the composition to a gel, after which heating and sintering is carried out to form the glass.

In the electrospraying/sintering procedure, the material is first made by placing the components of the composition, e.g., a barium aluminosilicate, in a crucible, and heating the composition to high temperature to form the glass, similarly to the standard technique for making glass-ceramic. The resulting composition is then ground down into a fine powder, and the fine powder is suspended in a stream of flowing air to form a fluidized bed. The particles from the fluidized bed are then carried by a flowing gas stream, such as air, passing through the fluidized bed, and the gas stream containing the glass particles is then passed through a conventional electrospraying apparatus so that the particles pick up an electrostatic charge. The metal substrate to which the particles are to be applied is grounded, and the glass particles are sprayed onto the grounded substrate, where the glass particles become electrostatically adhered to the substrate. The substrate is then heated to form the particles of glass-ceramic directly on the substrate.

In electrophoresis, charged particles suspended in a liquid move through the liquid to the substrate, which functions as an electrode, under the influence of an electric field applied across the suspension. Similarly, thermophoresis is the movement of suspended particles through a solution as the result of an applied thermal gradient.

The thickness of the initial layer, which functions chiefly as a bonding layer, can vary but is generally from about 1 to about 50 μm thick. The initial glass-ceramic layer also functions as a hydrogen and oxygen diffusion barrier.

As previously noted, although the glass-ceramic first layer provides a good hydrogen and oxygen diffusion barrier, it is preferred in many cases to increase the diffusion barrier characteristics by adding a second layer of material to provide extremely low gas permeation. This second layer can be composed of alumina ($Al_2O_3$) or silicon carbide (SiC). Either layer can be applied by any of several known procedures. Thus, the preferred procedure for the application of a silicon carbide layer is chemical vapor deposition. The preferred procedures for depositing an alumina second layer are sol-gel or electrospraying/sintering, as described above. The thickness of the second layer can vary but, like the first layer, can range from about 2 to about 50 μm thick.

The final layer is composed of silica ($SiO_2$) or a high-silica material containing silica and a minor portion of boron oxide ($B_2O_3$). Thus, for example, such high-silica material can contain 4% boron oxide, or other high temperature borosilicate glasses can be employed. A thin layer of this material can be deposited by various methods, such as sol-gel or hydrolysis of ethyl silicate and borates. The thickness of such layer can range from about 1 to 5 μm. The emittance of the underlying second layer of $Al_2O_3$ or SiC gives this coating a high emittance. This final or third layer also provides a low catalycity surface.

However, for the thicker version of the third layer, ranging from about 3 to 5 μm thick, particles of a dark solid, such as boron silicide ($BSi_x$), ferrous oxide (FeO), ferric oxide ($Fe_2O_3$), nickel oxide (NiO), manganese dioxide ($MnO_2$), carbon or silicon carbon (SiC) can be incorporated to increase emittance even more. Such particles can be of a size ranging from about 0.01 to 5 μm and can be present in an amount off bout 10 to about 70% by weight of the final layer.

Since the glass-ceramic first layer provides a good hydrogen and oxygen diffusion barrier, in some instances, the second or hydrogen diffusion barrier layer can be deleted and the third layer applied directly over the first layer.

Alternatively, the second and the third layers can be omitted, and the high-silica surface and the function thereof, preferably provided by the first layer. This can be achieved by an acid leach of the first layer surface, e.g., employing sulfuric acid, phosphoric acid, nitric acid, or hydrochloric acid, to remove cations, such as barium or aluminum ions, from the initial glass-ceramic surface. This essentially results in a thin high-silica surface on the first glass-ceramic layer. The resulting single layer essentially possesses all of the functions of being a bonding layer, a hydrogen diffusion barrier, and having high emittance and low catalytic activity.

Thus, while the application of all three layers is preferred, to obtain all of the characteristics and advantages of the oxidation protection coating of the invention, it is possible to employ only a single, that is, first layer, treated as noted above, or a combination of the first and third layers. In fact, the first and second layers can be used alone if the second layer is SiC since the surface of SiC will oxidize when exposed to the atmosphere to form a thin layer of $SiO_2$ (the third layer of the coating).

The following are examples of practice of the invention:

EXAMPLE 1

A Coating Composed of Barium Aluminosilicate, SiC and $SiO_2$ Layers on Titanium Aluminide ($Ti_3Al$)

A substrate of $Ti_3Al$ having a coefficient of thermal expansion of approximately $1.1\times10^{-5}$ cm/cm per °C. is to be coated for oxidation protection according to the invention first with a barium aluminosilicate having a similar coefficient of thermal expansion. An exemplary composition of this type is composed of 31.0% by weight BaO, 20.5% by weight $Al_2O_3$, and 48.5% by weight $SiO_2$.

Thus, a mixture of 31.0 grams BaO, 20.5 grams $Al_2O_3$, and 48.5 grams $SiO_2$ of reagent-grade materials is prepared. This composition is ball-milled, mixed and melted in a platinum crucible in an electric furnace at 1650° C. with intermittant agitation for approximately 100 hours or until the molten glass is homogeneous. The BaO can also be added as the equivalent amount of $BaCO_3$. Approximately 7% by weight of a nucleating agent, such as $SnO_2$ or $TiO_2$, can be added. If a darker color is desired in the layer, 0.5% by weight of nickel oxide (NiO) can be used as the agent.

The molten glass is then quenched and ground into a very fine powder (0.1 to 10 μm diameter), depending on the uniformity and thickness desired in the final coating.

The powder is electrosprayed onto the titanium aluminide substrate and is heated for five hours at 750° C., then one hour at 1100° C., and finally three hours at 925° C. The system is then allowed to cool. The thickness of this initial glass-ceramic coating is 14 μm.

To enhance the hydrogen diffusion barrier properties of the coating, an SiC or $Al_2O_3$ layer is added. An SiC layer is added by using a chemical vapor deposition (CVD) or a variation known as plasma-assisted CVD (PACVD). In PACVD, the preferred method, the reactants ($SiH_4$ and hydrocarbon—$C_xH_y$) are introduced into a high energy radio frequency (rf) glow discharge chamber where they decompose and subsequently deposit SiC on the barium aluminosilicate first layer. The temperature of the substrate can be in the range orates of 200° to 500° C. The flow rates of the silane and hydrocarbon depend on the configuration of the chamber. After the desired thickness (e.g., 5 μm), of SiC is laid down, the part is removed and allowed to cool.

To apply the final layer, sol-gel technology is used. Five grams of tetraethylorthosilicate (TEOS) is dissolved in ethyl alcohol (mole ratio of 1 to 5) in a three-necked flask with stirring. Then water containing 6.1% by weight $HNO_3$ is added, the mole ratio of water/tetraethylorthosilicate being 6. The solution is refluxed at 70° C. for eight hours. The resulting clear solution is diluted 1 to 2 with additional ethyl alcohol and is spread over the SiC layer in a layer about 0.1 mm thick. The article is then heated in an argon atmosphere at 500° C. to drive off unwanted components and leave just 1 μm of the $SiO_2$.

EXAMPLE 2

The procedure of Example 1 is followed except that the first layer is composed of an $Al_2O_3$—$SiO_2$ glass-ceramic composition having a coefficient of thermal expansion of approximately $1.1\times10^{-5}$ cm/cm/°C. Such composition consists of 23% by weight $Al_2O_3$ and 77% by weight $SiO_2$. As in the case of the barium aluminosilicate glass-ceramic composition of Example 1, the $Al_2O_3$ and $SiO_2$ are ball-milled, mixed, and heated for 5–10 hours at 1900° C. in a gas-oxygen fired furnace and agitated until homogeneous. After quenching, the glass-ceramic is ground and electro-sprayed onto the titanium aluminide substrate. The sprayed article is heated for 10 hours at 1190° C. to achieve the desired coefficient of thermal expansion. If desired, the $Al_2O_3$ may be selectively leached from the surface using 85% $H_3PO_4$ at 40° C. for three hours.

EXAMPLE 3

Particles of dark solids, such as $BSi_x$ (boron silicide), FeO, $Fe_2O_3$, NiO, $MnO_2$ or SiC can be added to the TEOS in preparing the final layer in Example 1, to increase the emittance of the coating. The particles can be added in an amount up to 70% by weight of the final high silica third layer, and the diameter of such particles can be from about 0.1 to about 5 μm, depending on the thickness of this layer.

EXAMPLE 4

The final layer can consist of a high silica glass applied by sol-gel technology. Following the procedure of Example 1, the final layer can be prepared using TEOS and boron triisopropoxide, using the sol-gel procedure of Example 1, with the boron triisopropoxide added to a partially hydrolyzed solution of the TEOS. Thus, if a final layer of a high silica glass consisting of 96% $SiO_2$ and 4% $B_2O_3$ is desired, 333 grams of TEOS and 21 grams of boron triisopropoxide is used.

From the foregoing, it is seen that the invention of this application provides an effective, highly adherent oxidation protective coating for metal surfaces having a number of advantages, including good adherence to the substrate under varying temperature conditions, particularly high temperatures, such as thermal cycling to 1000° C., high emittance, providing a hydrogen and oxygen diffusion barrier, and having low catalytic activity, particularly for the recombination of atomic oxygen and nitrogen.

It is be understood that what has been described is merely illustrative of the principles of the invention and that numerous arrangements in accordance with this invention may be devised by one skilled in the art without departing from the spirit and scope thereof.

What is claimed is:

1. A coating on a metal substrate for oxidation protection of metal surfaces thereof which comprises:

a first layer of a glass-ceramic selected from the group consisting of (a) baria, silica, and alumina, (b) silica-alumina, and (c) baria-silica, a second layer comprising alumina or silicon carbide, and a third layer comprised of silica or a high silica material.

2. The coating of claim 1, said first layer selected to match the coefficient of thermal expansion of the substrate and functioning as a bonding layer, said second layer providing a hydrogen diffusion barrier, and said third layer having high emittance and low catalytic activity.

3. The coating of claim 1, said first and second layers having a thickness of about 1 to about 50 μm and said third layer having a thickness of about 1 to about 5 μm.

4. The coating of claim 1, said first layer being comprised of baria, silica and alumina, said second layer comprised of silicon carbide and said third layer comprised of a high silica material.

5. The coating of claim 1, said metal substrate being selected from the group consisting of aluminum, titanium, beryllium, the refractory metals, and alloys thereof.

6. The coating of claim 1, said metal substrate being titanium aluminide.

7. The coating of claim 4, said metal substrate being titanium aluminide.

8. The coating of claim 1, said first layer containing a minor proportion of titanium dioxide, nickel oxide or $SnO_2$.

9. The coating of claim 1, said third layer being a high silica material containing a minor portion of boron oxide.

10. The coating of claim 1, said third layer containing particles of a member selected from the group consisting of boron silicide, ferrous oxide, ferric oxide, NiO, manganese dioxide, carbon and SiC.

11. The coating of claim 1, the glass-ceramic (a) containing 30–60% silica, 20–55% baria, and 7–25% alumina, said glass-ceramic (b) containing 97–30% silica and 3–70% alumina, and said glass-ceramic (c) containing 18–54% silica and 46–82% baria, by weight.

12. The coating of claim 1, including about 0.1 to about 18% nickel oxide, titanium dioxide or $SnO_2$, by weight, in said first layer as nucleation catalyst and wherein said third layer is a high silica material containing a minor portion of boron oxide.

13. The coating of claim 12, said third layer containing particles of a member selected from the group consisting of boron silicide, nickel oxide, ferrous oxide, ferric oxide, manganese dioxide, carbon and silicon carbide, in an amount of about 10 to about 70% by weight of said third layer, said particles having a size ranging from about 0.01 to 5 μm.

14. The coating of claim 12, said first and second layers having a thickness of about 1 to about 50 μm and said third layer having a thickness of about 1 to about 5 μm, the glass-ceramic (a) containing 30–60% silica, 20–55% baria, and 7–25% alumina, said glass-ceramic (b) containing 97–30% silica and 3–70% alumina, and said glass-ceramic (c) containing 18–54% silica and 46–82% baria, by weight.

15. A coating on a metal substrate for oxidation protection of metal surfaces thereof which comprises:

a first layer of a glass-ceramic selected from the group consisting of (a) baria, silica and alumina, (b) silica-alumina, and (c) baria-silica, and an additional layer comprised of silica or a high silica material.

16. The coating of claim 15, said first layer having a thickness of about 1 to about 50 μm and said additional layer having a thickness of about 1 to about 5 μm.

17. The coating of claim 15, said additional layer being a high silica material containing a minor portion of boron oxide.

18. The coating of claim 15, the glass-ceramic (a) containing 30–60% silica, 20–55% baria, and 7–25% alumina, said glass-ceramic (b) containing 97–30% silica and 3–70% alumina, and said glass-ceramic (c) containing 18–54% silica and 46–82% baria, by weight.

19. The coating of claim 15, including about 0.1 to about 18% nickel oxide, titanium dioxide or $SnO_2$, by weight, in said first layer as nucleation catalyst and wherein said additional layer is a high silica material containing a minor portion of boron oxide.

20. A coating on a metal substrate for oxidation protection of metal surfaces thereof which comprises:

a first layer of a glass-ceramic selected from the group consisting of (a) baria, silica and alumina, (b) silica-alumina, and (c) baria-silica, and an additional layer of silicon carbide.

21. A process for applying a coating to a metal substrate for oxidation protection thereof, which comprises:

applying a first layer of a glass-ceramic selected from the group consisting of (a) baria, silica and alumina, (b) silica-alumina, and (c) baria-silica, applying a second layer comprising alumina or silicon carbide, and applying a third layer comprised of silica or a high silica material.

22. The process of claim 21, said first layer being applied by sol-gel, electrospraying/sintering, electrophoresis or thermophoresis, said second layer being applied by chemical vapor deposition, sol-gel or electrospraying/sintering, and said third layer being applied by sol-gel or hydrolysis of ethyl silicate and borates.

23. The process of claim 21, said first and second layers having a thickness of about 1 to about 50 μm and said third layer having a thickness of about 1 to about 5 μm.

24. The process of claim 21, said metal substrate being selected from the group consisting of aluminum, titanium, beryllium and refractory metals, and alloys thereof.

25. The process of claim 21, the glass-ceramic (a) containing 30–60% silica, 20–55% baria, and 7–25% alumina, said glass-ceramic (b) containing 97–30% silica and 3–70% alumina, and said glass-ceramic (c) containing 18–54% silica and 46–82% baria, by weight.

26. The process of claim 21, including about 0.1 to about 18% nickel oxide, titanium dioxide or $SnO_2$, by weight, in said first layer as nucleation catalyst and wherein said third layer is a high silica material containing a minor portion of boron oxide.

27. The process of claim 21, said third layer containing particles of a member selected from the group consisting of boron silicide, ferrous oxide, nickel oxide, ferric oxide, manganese dioxide, carbon and silicon carbide, in an amount of about 10 to about 70% by weight of said third layer.

28. A process for applying a coating to a metal substrate for oxidation protection thereof, which comprises:

applying a layer of a glass-ceramic selected from the group consisting of (a) baria, silica and alumina, (b) silica-alumina, and (c) baria-silica, and acid leaching said layer to remove cations and forming a high silica surface on said glass-ceramic layer.

29. The process of claim 28, said acid leaching being carried out with an acid selected from the group consisting of phosphoric, sulfuric, nitric and hydrochloric acids, and removing barium and aluminum cations.

30. A coating on a metal substrate for oxidation protection thereof, produced by the process of claim 28, said coating having low catalycity and high emittance.

* * * * *